US006512900B2

(12) United States Patent
Sakai

(10) Patent No.: US 6,512,900 B2
(45) Date of Patent: Jan. 28, 2003

(54) IMAGE FORMING APPARATUS HAVING ALARM WHICH INDICATES CARRIER SOLVENT FILTER REPLACEMENT OR LACK OF SOLVENT SUPPLY

(75) Inventor: Shinichi Sakai, Niigata (JP)

(73) Assignee: Fuji Xerox Co., Ltd. (JP)

( * ) Notice: Subject to any disclaimer, the term of this patent is extended or adjusted under 35 U.S.C. 154(b) by 0 days.

(21) Appl. No.: 09/732,654

(22) Filed: Dec. 6, 2000

(65) Prior Publication Data

US 2001/0002952 A1 Jun. 7, 2001

(30) Foreign Application Priority Data

Dec. 6, 1999 (JP) ..... 11-346245

(51) Int. Cl.[7] ..... G03G 21/20
(52) U.S. Cl. ..... 399/93; 399/250; 399/57
(58) Field of Search ..... 399/24, 31, 250, 399/251, 93, 57; 340/607, 611, 626; 95/19, 23, 278, 284; 96/398, 421

(56) References Cited

U.S. PATENT DOCUMENTS 4,666,282 A * 5/1987 Rowe ..... 15/301
4,733,272 A * 3/1988 Howe et al. ..... 219/216
4,786,295 A * 11/1988 Newman et al. ..... 340/607
5,899,600 A * 5/1999 Hockey et al. ..... 399/92
6,131,004 A * 10/2000 Cho et al. ..... 399/249

FOREIGN PATENT DOCUMENTS

JP 56094834 A * 7/1981 ..... H03K/13/20

* cited by examiner

*Primary Examiner*—Robert Beatty
(74) *Attorney, Agent, or Firm*—Ostrolenk, Faber, Gerb & Soffen, LLP

(57) ABSTRACT

A wet type electrophotographic image forming apparatus is capable of indicating timing of replacement of filter due to influence of solvent used in the process of image formation whereby to cause degradation of image quality or fatigue of parts and to restrict discharged vapor concentration of collected solvent. The image forming apparatus employing an ink containing a solvent includes a liquefying device for cooling the solvent evaporated during an image forming process and collecting liquefied solvent, an air pump sucking vapor left unliquefied by the liquefying device and maintained in a vapor state, a pressure sensor detecting a suction pressure of the air pump, and alarm device for comparing an absolute value of a pressure data generated by the pressure sensor and indicative of the suction pressure and a predetermined pressure range and generating an alarm when the absolute value of the pressure data is output of the pressure range.

6 Claims, 1 Drawing Sheet

IMAGE FORMING APPARATUS HAVING ALARM WHICH INDICATES CARRIER SOLVENT FILTER REPLACEMENT OR LACK OF SOLVENT SUPPLY

BACKGROUND OF THE INVENTION

1. Field of the Invention

The present invention relates to a wet electrophotographic image forming apparatus using a solvent. More particularly, the invention relates to an image forming apparatus which can appropriately manage replacement timing of consumables, an image quality management method and a storage medium recording a program executable of the method.

2. Description of the Related Art

Conventionally, an electrophotographic image forming apparatus forms an electric latent image on a photosensing body by means of laser or the like, develops the latent image using a toner, transfers a toner image to a medium to be transferred the toner image, such as a paper or the like, and then fixes the transferred image by heating and pressurizing for obtaining a printed product.

Also, as a wet type electrophotographic image forming apparatus employing an ink, the ink prepared by dispersing a toner particle in a solvent, solidifying the ink by removing the solvent in the ink. Such wet type electrophotographic image forming apparatus utilizes a property of solidifying ink to be transferred to a substance having higher affinity among substances. As means for removing the solvent from the ink, there is a technology for removing a residual solvent by a rotary absorbing body after squeezing off the solvent by a squeezing pressure of a squeezing roller provided at downstream side of a developing portion. In such case, in order to ensure recovery performance of the rotary absorbing body, the absorbed solvent is evaporated by heat. However, for environmental protection, the evaporated solvent is cooled, liquefied and collected. The residual solvent vapor left non-liquefied is discharged out of the image forming apparatus through a filter by means of an air pump.

In the conventional image forming apparatus, an activated charcoal or the like is used as a filter material. Since the filter may have a life time, it is required to be replaced regularly. Considering the filter as consumables, if a user does not replace the filter, collection performance for the evaporated solvent is inherently lowered to be discharged in increased concentration of solvent vapor. Discharge of high concentration solvent vapor should cause pollution in the environment.

On the other hand, concerning like time of the filter, it is frequently defined as a given period of use. However, since actual life time of the filter is significantly variable depending upon use frequency and use environment. Therefore, replacement cannot be performed at an appropriate timing to make environment protection and maintenance by the user unsatisfactory.

Furthermore, at the occurrence of lowering air flow amount due to blocking of the filter, failure of the air pump or any other reason, concentration of solvent vapor in the image forming apparatus becomes higher to potentially cause malfunction of various photosensors, lowering of an exposure laser amount and so forth to cause degradation of image quality and to cause fatigue of parts.

SUMMARY OF THE INVENTION

The present invention has been worked out in view of the drawbacks in the prior art as set forth above. It is therefore an object of the present invention to indicate replacement of filter due to influence of solvent used in the process of image formation whereby to cause degradation of image quality or fatigue of parts and to restrict discharged vapor concentration of collected solvent.

According to the first aspect of the present invention, a wet type electrophotographic image forming apparatus employing an ink containing a solvent, comprises:

- a liquefying device for cooling the solvent evaporated during an image forming process and collecting liquefied solvent;
- an air pump sucking left unliquefied by the liquefying device and maintaining in a vapor state;
- a pressure sensor detecting a suction pressure of the air pump;
- alarm means for comparing an absolute value of a pressure data generated by the pressure sensor and indicative of the suction pressure and a predetermined pressure range and generating an alarm when the absolute value of the pressure data is output of the pressure range.

In the preferred embodiment, the alarm means makes judgment of initial failure of a filter for absorbing and removing the solvent in vapor state or installation failure of the filter when the absolute value of the pressure data is greater than the pressure range, and makes judgment of fatigue of the filter or abnormality of the air pump when the absolute value of the pressure data is smaller than the pressure range.

On the other hand, the image forming apparatus may further comprises a concentration sensor provided in the vicinity of a rotary absorbing body for absorbing the solvent, for detecting a vapor concentration of solvent. In such case, the alarm means may compares a vapor concentration data generated by the concentration sensor with a predetermined vapor concentration range while the air pump is in operation normally, to make judgment of lacking of solvent supply when the vapor concentration is smaller than the vapor concentration range and to make judgment of fatigue of the filter when the vapor concentration data is greater than the vapor concentration range for alarming.

According to the second aspect of the present invention, an image quality management method in an image formation by means of a wet type electrophotographic image forming apparatus employing an ink containing a solvent, comprising:

- a first step of preliminarily setting a pressure range of a suction pressure of an air pump which sucks the solvent in vapor state which is left unliquefied from a liquefying device which cools the solvent evaporated during an image forming process and collects liquefied solvent and maintained in a vapor state, by means of an air pump left; and
- a second step of comparing an absolute value of a pressure data generated by a pressure sensor detecting a suction pressure of the air pump and indicative of the suction pressure and the predetermined pressure range and generating an alarm when the absolute value of the pressure data is output of the pressure range.

Preferably, in the second step, judgment of initial failure of a filter for absorbing and removing the solvent in vapor state or installation failure of the filter is made when the absolute value of the pressure data is greater than the pressure range, and judgment of fatigue of the filter or abnormality of the air pump is made when the absolute value of the pressure data is smaller than the pressure range.

Further preferably, in the first step, a vapor concentration range of the solvent in the vicinity of a rotary absorbing body which absorbs the solvent remained on a photosensitive belt as a photosensitive body is preliminarily determined, and in the second step, a vapor concentration data generated by detecting a vapor concentration of the solvent is compared with the predetermined vapor concentration range while the air pump is in operation normally, to make judgment of lacking of solvent supply when the vapor concentration is smaller than the vapor concentration range and to make judgment of fatigue of the filter when the vapor concentration data is greater than the vapor concentration range for alarming.

According to the third aspect of the invention, a storage medium storing a program for implementing an image quality management method as set forth above.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are for explanation and understanding only.

In the drawings:

Figure 1:
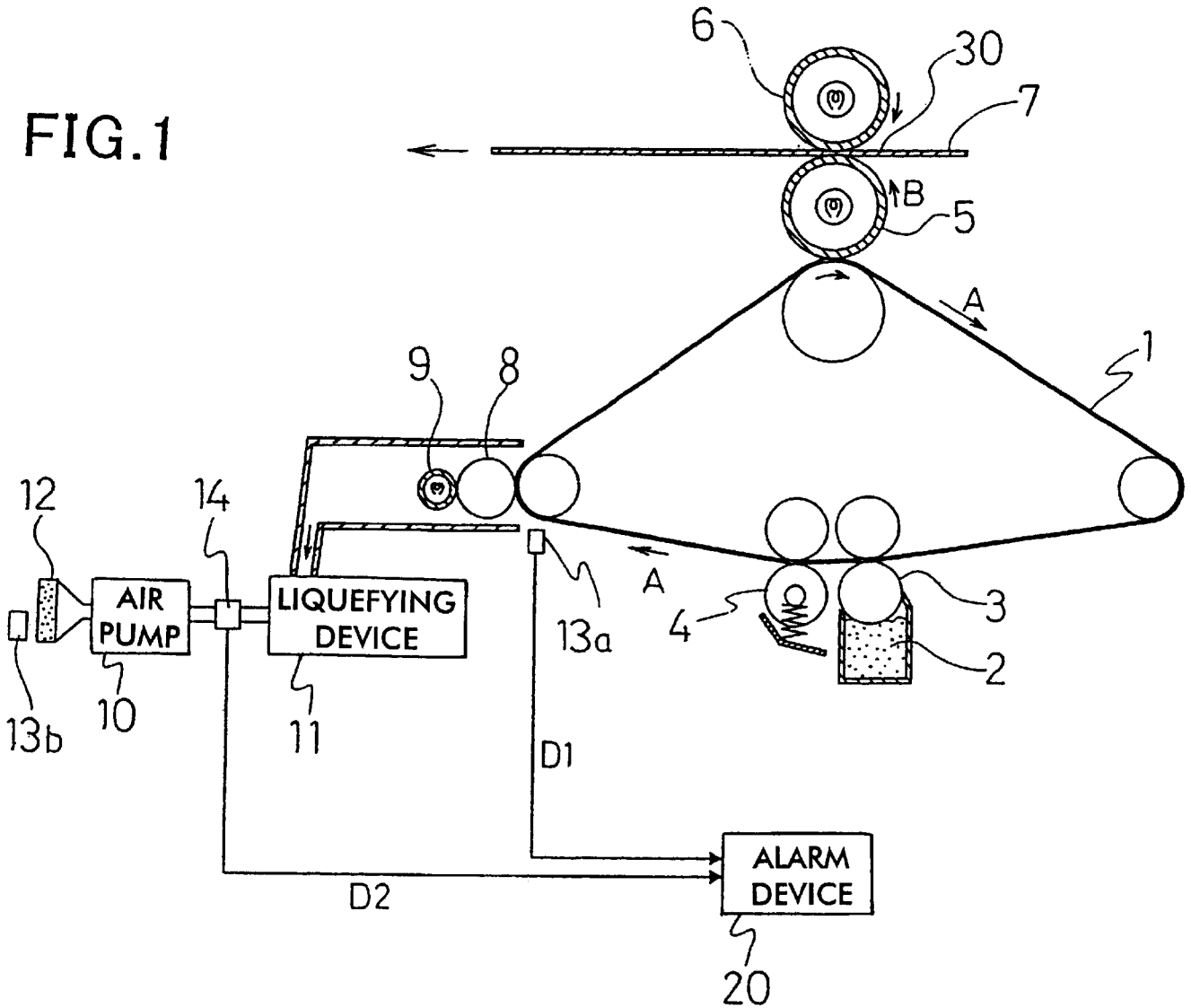

A sole FIGURE is a diagrammatic illustration showing the preferred embodiment of an image forming apparatus according to the present invention.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structure are not shown in detail in order to avoid unnecessary obscurity of the present invention.

Referring now to FIG. 1, the preferred embodiment of an image forming apparatus is generally constructed with a photosensitive belt 1, a developer roller 3, a squeezing roller 4, a transfer roller 5, a fuser roller 6, a rotary absorbing body 8, a drying roller 9, an air pump 10, a liquefying device or a condenser 11, a filter 12, first and second concentration sensors 13*a* and 13*b*, a pressure sensor 14, an alarm device (alarm display means) 20. In FIG. 1, as consumables, ink 2 and a paper 7 are also shown.

The photosensitive belt 1 serves as a photosensitive body for forming a latent image. The developer roller 3 develops the latent image on the photosensitive belt by means of ink 2 which is prepared distributing toner in the solvent. The squeezing roller 4 removes the solvent by application of a pressure to the ink forming the developed mage. The transfer roller 5,is provided with an internal heater. The fuser roller 6 is in contact with the transfer roller 5 and is provided with an internal heater.

Transporting roller (not shown), a nip portion 30 is formed together with the transfer roller 5 and the fuser roller 6 for transporting or feeding a paper (hereinafter optionally referred to as "printing medium") 7.

The ink 2 forming the image developed on the photosensitive belt 1 is removed the solvent by heat, pressure or so forth to be solidified. Then, solidifying solvent has a property to be transferred to a substance having higher affinity. The affinities of the photosensitive belt 1, the transfer roller 5 and the paper 7 are set to be in ascending order. Thus, the developed image of the ink 2 is transferred to the paper 7.

The rotary absorbing body 8 is provided at a predetermined position contacting with the photosensitive belt 1 upstream side of the transfer roller 5 (between the transfer roller 5 and the squeezing roller 4) for removing the solvent in the residual ink 2. The drying roller 9 has a heater inside thereof in order to maintain absorbing performance of the rotary absorbing body 8.

The liquefying device 11 cools and liquefies the vaporized solvent for collection. The air pump 10 sucks solvent vapor held unliquefied to discharge out of the image forming apparatus from a ventilation opening through the filter 12. At this time, the filter 12 absorbs and removes the solvent vapor.

The second concentration sensor 13*b* detects discharge vapor concentration of evaporated solvent to be discharged out of the image forming apparatus. On the other hand, the first concentration sensor 13*a* detects vapor concentration of the solvent in the vicinity of the rotary absorbing body 8 absorbing the solvent. A vapor concentration data D1 generated on the basis of the detected vapor concentration is fed to the alarm device 20.

The pressure sensor 14 detects a suction pressure of the air pump 10. A pressure data D2 (negative pressure) generated on the basis of the detected suction pressure is fed to the alarm device 20.

The alarm device 20 compares the input pressure data D2 and a preliminarily set pressure range for detecting abnormality in lowering air flow amount due to blocking of the filter 12, failure of the air pump 10 and other causes, initial failure or installation failure of the filter 12, for alarming occurrence of abnormality. Also, the alarm device 20 compares the input vapor concentration data D1 and a preliminarily set vapor concentration range of the solvent for detecting abnormality in steps of image forming process, blocking due to fatigue of the filter 12, lacking of supply amount of the solvent on the basis of a result of comparison and other causes for alarming.

Alarming is given for the user by way of alarm sound, voice message, character display and so forth. The user may know abnormality in the steps of image forming process or replacement timing of the filter 12.

Next, discussion will be given for the method using the image forming apparatus in greater detail. The photosensitive belt 1 serving as the photosensitive body circulates in a direction of arrow A shown in FIG. 1. By means of a charging device (not shown), a photosensitive surface of the photosensitive belt 1 is charged uniformly. Next, by an irradiation light, such as laser or the like, a latent image of a image to be printed is formed on the photosensitive surface. Similarly to existing wet type electrophotographic technology, the ink 2 which is prepared by dispersing toner particle in the solvent is deposited on the portion where the latent image is formed on the photosensitive belt 1 by means of the developing roller 3.

As set forth above, the ink 2 forming the developed image on the photosensitive belt 1 is solidified by removal of the solvent. Then, the solidified ink 2 has a property to be transferred to the substance having higher affinity. For this purpose, the photosensitive belt 1 is contacted with the squeezing roller 4 located downstream side of the developing roller 3. The squeezing roller 4 is urged onto the photosensitive belt by a predetermined pressure for removing a given amount of solvent from the ink 2 to cause solidification of the ink forming the developed image in a predetermined level. Thereafter, the developed image on the photosensitive belt 1 is carried across the rotary absorbing body 8. While passing across the rotary absorbing body 8, the ink 2 forming the developed image is further removed the solvent as absorbed by the rotary absorbing body 8 to be solidified sufficiently.

By providing higher affinity with the ink 2 for the transfer roller 5 than that of the photosensitive belt 1, the ink on the photosensitive belt 1 is transferred to the transfer roller 5. The transfer roller 5 incorporating the internal heater rotates in a direction indicated by arrow B.

Next, the paper or other printing medium 7 is fed to the nip portion 30 defined between the fuser roller 6 and the transfer roller 5. The ink 2 of the transferred image is then mate with the paper 7 at a predetermined registered position. The affinity of the transfer roller 5 is set to be lower than that of the paper 7. Therefore, the solidified ink of the image is transferred from the transfer roller 5 to the paper 7. At the same time, by a heat generated by the heater in the transfer roller and a pressure exerted between the transfer roller 5 and the fuser roller 6, the solvent in the ink 2 is completely removed to fix the image on the paper 7.

On the other hand, the drying roller 9 incorporating an internal heater is provided in contact with the rotary absorbing body 8 and applying a heat to the latter for maintaining absorbing performance of the rotary absorbing body. The drying roller 9 thus evaporates the solvent absorbed by the rotary absorbing body 8.

The liquefying device 11 arranged in a pipe line up to the air pump 10 liquefies the evaporated solvent. The liquefying device 11 performs collection by collection by evaporated solvent. In order to collect approximately 100% of solvent in a gas, cooling is performed by air cooling or water cooling in viewpoint of size, weight and cost.

The air pump 10 sucks solvent unliquefied and whereby left in vapor condition to discharge output of the apparatus after impoverishing by the filter 12. At this time, the filter 12 absorbs and removes the evaporated solvent.

The pressure sensor 14 detects the suction pressure by the air pump 10 from the liquefying device 11 by the air pump 10. The pressure sensor 14 feeds the pressure data D2 generated on the basis of the detected suction pressure to feed the alarm device 20.

On the other hand, the second concentration sensor 13*b* detects the discharge vapor concentration of the evaporated solvent out of the image forming apparatus. The first concentration sensor 13*a* detects the vapor concentration of the solvent and generates the vapor concentration data D1 on the basis of the vapor concentration of the detected solvent is fed to the alarm device 20.

The alarm device 20 generates an alarm upon occurrence of abnormality of the input vapor concentration data D1 and the pressure data D2.

Particular alarming method will be discussed. The predetermined pressure range for the suction pressure of the air pump 10 and vapor concentration range for the solvent are preliminarily set.

If an absolute value of the pressure data (negative pressure) D2 input from the pressure sensor 14 is in excess of the set pressure range, judgment is made that initial failure of the filter 12 or installation failure of the filter 12 is caused. On the other hand, if the absolute value of the pressure data (negative pressure) D2 is less than the set pressure range, judgment is made that blocking of the filter 12 due to fatigue or lowering of air flow amount due to failure of the air pump 10 is caused.

On the other hand, when abnormality is not caused in the air pump 10 and if the vapor concentration data D1 input from the first concentration sensor 13*a* is in excess of the set vapor concentration range, judgment is made that fatigue is caused in the filter 12. On the other hand, if the vapor concentration data D1 is less than the set vapor concentration range, judgment is made that lacking of solvent supply or abnormality in the steps of image forming process is caused.

The alarm device 20 is responsive to the results of judgment for alarming to the user by way of alarm sound, voice message, character display or so forth if any abnormality is judged. The user may know abnormality in the steps of image forming process or replacement timing of the filter 12.

As a result, it becomes possible to provide timely notice for end of life time of the filter or prevent abnormal solvent vapor concentration in the image forming process. Thus, the user may know the timing of replacement of the filter to avoid discharging of the high vapor concentration of evaporated solvent out of the image forming apparatus.

Since the shown embodiment of the image forming apparatus is constructed as set forth above, the following effects can be achieved.

Since the end of life of the filter 12 as consumables can be noticed timely, it becomes possible to avoid degradation of the image quality or fatigue of the parts due to increasing of vapor concentration of the evaporated vapor. Also, it ensures using of the filter up to the end of its life to lower running cost.

For instance, the present invention should not be applicable only for the shown type of the image forming apparatus but can be applicable for various types of image forming apparatus and image quality management method. Also, it is also set a plurality of pressure ranges and/or vapor concentration ranges such as the ranges for calling user's attention, the ranges for alarming and so forth.

Furthermore, number, position and shape and so forth of the components should not be limited to those in the shown embodiment and can be any suitable number, position, shape and so forth for implementing the invention.

With the construction as set forth above, since the present invention can avoid discharging of the solvent vapor out of the image forming apparatus in high concern, pollution of environment can be successfully prevented. Also, since the end of the life of the filter can be detected accurately, degradation of image quality and fatigue of the parts due to increasing of vapor concentration of solvent within the image forming apparatus can be successfully prevented.

What is claimed is:

1. A wet type electrophotographic image forming apparatus employing an ink containing a solvent, comprising:

a liquefying device for cooling said solvent evaporated during an image forming process and collecting liquefied solvent;

an air pump sucking vapor left unliquefied by said liquefying device and maintained in a vapor state;

a pressure sensor detecting a suction pressure of said air pump;

alarm means for comparing an absolute value of a pressure data generated by said pressure sensor and indicative of said suction pressure and a predetermined pressure range and generating an alarm when said absolute value of said pressure data is out of said pressure range;

a concentration sensor provided in the vicinity of a rotary absorbing body for absorbing said solvent, for detecting a vapor concentration of solvent, and said alarm means compares a vapor concentration data generated by said concentration sensor with a predetermined vapor concentration range while said air pump is in operation normally, to make judgment of lacking of solvent supply when said vapor concentration is smaller than said vapor concentration range and to make judgment of fatigue of said filter when said vapor concentration data is greater than said vapor concentration range.

2. An image quality management method in an image formation by means of a wet type electrophotographic image forming apparatus employing an ink containing a solvent, comprising:

a first step of preliminarily setting a pressure range of a suction pressure of an air pump which sucks said solvent in vapor state which is left unliquefied from a liquefying device which cools said solvent evaporated during an image forming process and collects liquefied solvent and maintained in a vapor state, by means of an air pump; and a second step of comparing an absolute value of a pressure data generated by a pressure sensor detecting a suction pressure of said air pump and indicative of said suction pressure and said predetermined pressure range and generating an alarm when said absolute value of said pressure data is out of said pressure range;

wherein, in said first step, a vapor concentration range of said solvent in the vicinity of a rotary absorbing body which absorbs said solvent remained on a photosensitive belt as a photosensitive body is preliminarily determined;

in said second step, a vapor concentration data generated by detecting a vapor concentration of said solvent is compared with said predetermined vapor concentration range while said air pump is in operation normally, to make judgment of lacking of solvent supply when said vapor concentration is smaller than said vapor concentration range and to make judgment of fatigue of said filter when said vapor concentration data is greater than said vapor concentration range.

3. A storage medium storing a program for implementing an image quality management method defined in claim 2.

4. A wet type electrophotographic image forming apparatus employing a filter absorbing and removing evaporated solvent, comprising:

a liquefying device for cooling said solvent evaporated during an image forming process and collecting liquefied solvent;

an air pump sucking vapor left unliquefied by said liquefying device and maintained in a vapor state;

a concentration sensor provided in the vicinity of a rotary absorbing body for absorbing said solvent, for detecting a vapor concentration of solvent, and alarm means comparing a vapor concentration data generated by said concentration sensor with a predetermined vapor concentration range while said air pump is in operation normally, to make judgment of lacking of solvent supply when said vapor concentration is smaller than said vapor concentration range and to make judgment of fatigue of said filter when said vapor concentration data is greater than said vapor concentration range.

5. An image quality management method in an image formation by means of a wet type electrophotographic image forming apparatus employing a filter absorbing and removing evaporated solvent, comprising:

a first step of preliminarily setting a vapor concentration range of said solvent in the vicinity of a rotary absorbing body which absorbs said solvent remained on a photosensitive belt as a photosensitive body; and a second step of comparing vapor concentration data generated by detecting a vapor concentration of said solvent with said predetermined vapor concentration range while said air pump is in operation normally, to make judgment of lacking of solvent supply when said vapor concentration is smaller than said vapor concentration range and to make judgment of fatigue of said filter when said vapor concentration data is greater than said vapor concentration range.

6. A storage medium storing a program for implementing an image quality management method defined in claim 5.

* * * * *